US006095110A

United States Patent [19]

Desclaux

[11] Patent Number: 6,095,110

[45] Date of Patent: Aug. 1, 2000

[54] INTERNAL COMBUSTION ENGINE

[76] Inventor: Michel Desclaux, Route de la Trinite, 31810 Venerque, France

[21] Appl. No.: 09/101,639

[22] PCT Filed: Nov. 13, 1997

[86] PCT No.: PCT/FR97/02035

§ 371 Date: Jul. 14, 1998

§ 102(e) Date: Jul. 14, 1998

[87] PCT Pub. No.: WO98/21458

PCT Pub. Date: May 22, 1998

[30] Foreign Application Priority Data

Nov. 14, 1996 [FR] France ..... 96 14109

[51] Int. Cl.[7] ..... F02B 73/00

[52] U.S. Cl. ..... 123/197.1

[58] Field of Search ..... 123/197.1, 52.4, 123/52.6, 198 D

[56] References Cited

U.S. PATENT DOCUMENTS

| | | | |
|---|---|---|---|
| 1,095,074 | 4/1914 | Blayney | 123/197.1 |
| 1,624,269 | 4/1927 | Marchetti | 123/197.1 |
| 2,085,270 | 6/1937 | Pavlecka | 123/52.6 |
| 2,117,118 | 5/1938 | Pavlecka | 123/52.6 |
| 2,264,648 | 12/1941 | Tebaldi | 123/52.4 |
| 2,303,025 | 11/1942 | Cliff | 123/52.4 |
| 2,347,444 | 4/1944 | Vincent | 123/197.1 |
| 3,390,670 | 7/1968 | Brice | 123/197.1 |
| 4,503,816 | 3/1985 | Gijbels et al. | 123/52.4 |

*Primary Examiner*—Marguerite McMahon
*Assistant Examiner*—Jason Benton
*Attorney, Agent, or Firm*—Birch, Stewart, Kolasch & Birch, LLP

[57] ABSTRACT

An internal combustion engine comprising the power take-off shaft and at least first and second crankshafts connected to the power take-off shaft by first and second linkages, respectively. The first and second linkages are each severable when their respective crankshafts are immobilized (e.g., by failure), such that the engine can continue to operated using the power from the operating crankshaft. The linkages break under a load less than or equal to a load necessary to immobilize the respective crankshafts.

22 Claims, 4 Drawing Sheets

INTERNAL COMBUSTION ENGINE

This application is the national phase under 35 U.S.C. §371 of prior PCT International Application No. PCT/FR97/02035 which has an International filing date of Nov. 13, 1997 which designated the United States of America, the entire contents of which are hereby incorporated by reference.

The present invention concerns internal combustion engines having at least one crankshaft attached to a power take-off shaft of the engine by a first rotating linkage system, a second crankshaft attached to a power take-off shaft of the engine by a second rotating linkage system, and concerns more particularly the engines intended to equip motorized ultralights (M.U.L.), autogyros, amateur light airplanes, hovercraft, hydrocraft, target drones, or the like.

A problem of utmost importance in this type of application in case of an engine failure is to ensure above all the safety of the pilots and eventual passengers, and to allow them to reach a stopping point with a maximum of safely. Another problem is to avoid the destruction of equipment due to incidents or accidents created directly or indirectly by engine failures. Consequently, a motorization for such applications must be very reliable and robust, while however remaining light, strong, and practical.

The object of the present invention is to propose a solution to the above problems and to incorporate other advantages. More precisely, it consists of an internal combustion engine composed of at least one crankshaft attached to the said power take-off shaft of said engine by a first rotating linkage system, a second crankshaft attached to the said power take-off shaft of said engine by a second rotating linkage system, characterized in that the said first rotating linkage system is reversible, and includes a first driving wheel which is completely attached in rotation to the said first crankshaft, via a first obstacle link capable of transmitting an engine load from the said first crankshaft toward the said power take-off shaft and capable of breaking, during a failure creating an immobility of the said first crankshaft, under a load that is inferior or equal to the load necessary to immobilize the said first crankshaft, and in that the said second rotating linkage system is reversible and includes a second driving wheel completely attached in rotation to the said second crankshaft via a second obstacle link being able to transmit an engine load from the said second crankshaft toward the said power take-off shaft and capable of breaking, during a failure leading to an immobilization of the said second crankshaft, under a load that is inferior or equal to the load necessary to immobilize the said second crankshaft.

The engine according to the invention can function in spite of the immobility of at least one crankshaft via a controlled breakage of the connection attaching the power take-off shaft to the immobilized crankshaft or which is intended to become immobilized following a failure, for example the seizing of a piston. In an engine according to the invention intended to equip a M.U.L. or the like, for example, the power take-off shaft that is interdependent with the propeller, will be able to continue to turn in spite of the immobility of a crankshaft, due to the effect of the engine torque created by the engine crankshaft or crankshafts that are not immobilized. Thus, the M.U.L. or the like will be able to reach a landing point safely, as opposed to having to suffer the uncertainties of a glide, in the case of the M.U.L., or fall, in the case of an autogyro for instance. It should be noted that the engine according to the invention can include advantageously more than two crankshafts.

According to an advantageous characteristic, the engine according to the invention has at least a third crankshaft in rotation, a third driving wheel, a third obstacle link.

This characteristic concerns an engine with three crankshafts, each attached to a power take-off shaft via an obstacle link that is capable of breaking. In the case of immobility of any of the crankshafts, the engine will continue to run on the other two crankshafts, the immobilized crankshaft being declutched from the power take-off shaft by the breakage of the obstacle link concerned.

The invention will be better understood and other characteristics and advantages will become apparent after reading the following example of a mode of realization of an engine according to the invention, accompanied by attached drawings, illustrative examples, and without the possibility of a restrictive interpretation of the invention.

Figure 1:
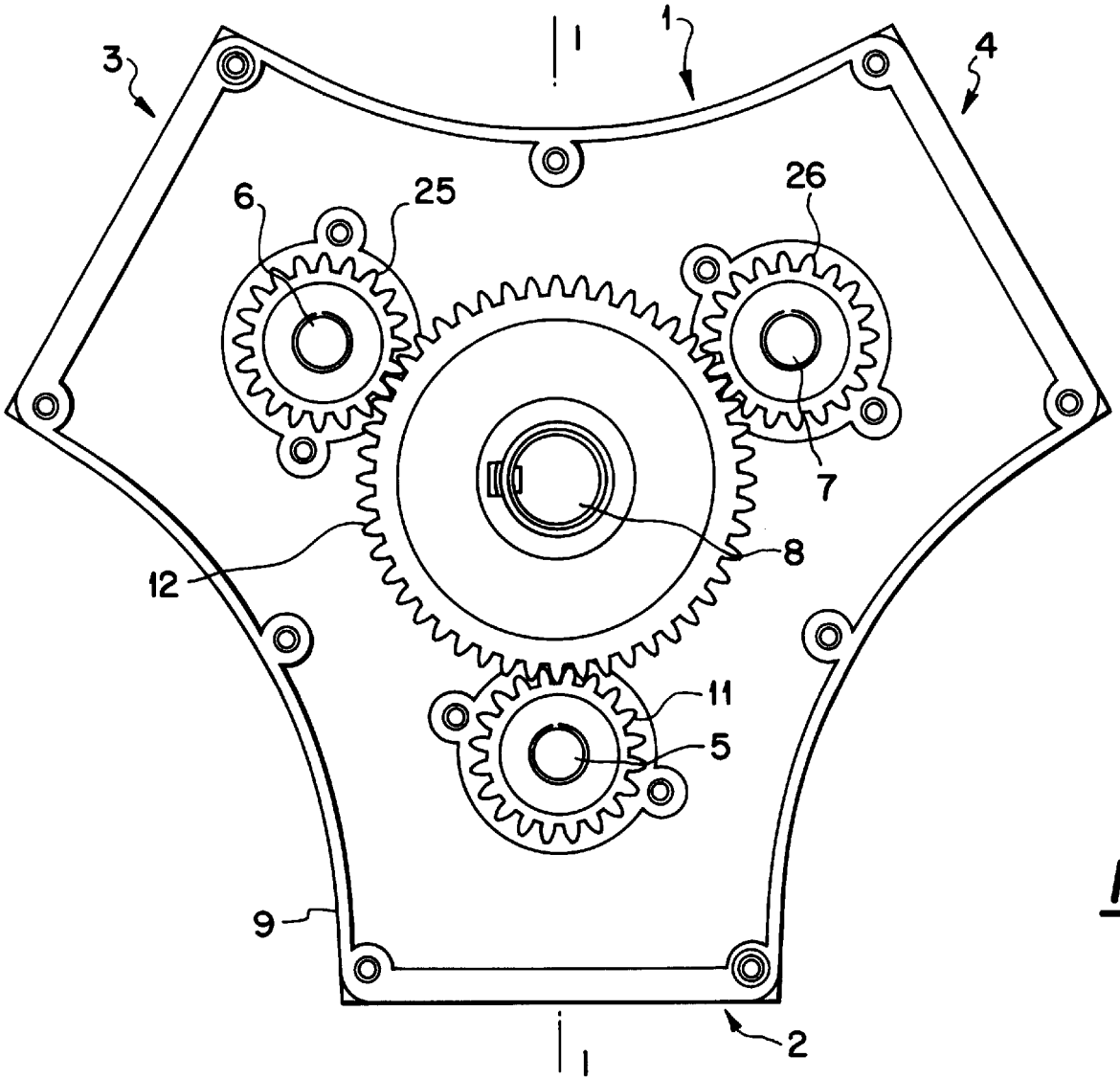
FIG. 1 shows a partial exploded front view of a realization example of an engine according to the invention.

The engine 1 represented on FIG. 1 is an internal combustion engine with three cylinders 2, 3, 4 placed in a star configuration (not represented), two cycles, especially appropriate to equip the machines described above. To each cylinder 2, 3, 4, corresponds a crankshaft 5, 6, 7, respectively. The engine 1 represented on FIGS. 1 and 2 has a first 5 crankshaft attached to a power take-off shaft 8 of the engine via a first rotating linkage system, a second 6 crankshaft attached to the power take-off shaft of the engine 8 via a second rotating linkage system, a third 7 crankshaft attached to the power take-off shaft 8 of the engine via a third rotating linkage system. The first 5, second 6, and third 7 crankshafts are guided in rotation in a crankcase 9 according to any known method, for example with bearings 10 as represented on FIG. 2. Note that FIG. 2 corresponds to a section of cylinder 2, following a line 1—1 of FIG. 1, but can correspond indiscriminately to the similar section of any of the other two cylinders 3 and 4. The power take-off shaft 8 is the engine arm on which the power of the engine is recovered and has a propeller (not represented) in the example.

The first rotating linkage system is reversible and includes a first 11 driving wheel completely attached in rotation to the first 5 crankshaft via a first obstacle link able to transmit an engine load created by the first 5 crankshaft toward the power take-off shaft 8 and capable of breaking, upon occurrence of a failure creating immobility of the first 5 crankshaft, under a load that is inferior or equal to the load necessary to immobilize the first 5 crankshaft. The second rotating linkage system is reversible and includes a second 25 driving wheel completely attached in rotation to the second 6 crankshaft via a second linkage by obstacle able to transmit an engine load created by the second 6 crankshaft toward the power take-off shaft 8 and capable of breaking, during a failure leading to immobilization of the second 6 crankshaft, under a load that is inferior or equal to the load necessary to immobilize the second 6 crankshaft. The third rotating linkage system is reversible and includes a third 26 driving wheel completely attached in rotation to the third 7 crankshaft via a third linkage by obstacle able to transmit an engine load created by the third 7 crankshaft toward the power take-off shaft 8 and capable of breaking, during a failure leading to immobilization of the third 7 crankshaft, under a load that is inferior or equal to the load necessary to immobilize the third 7 crankshaft.

Figure 2:
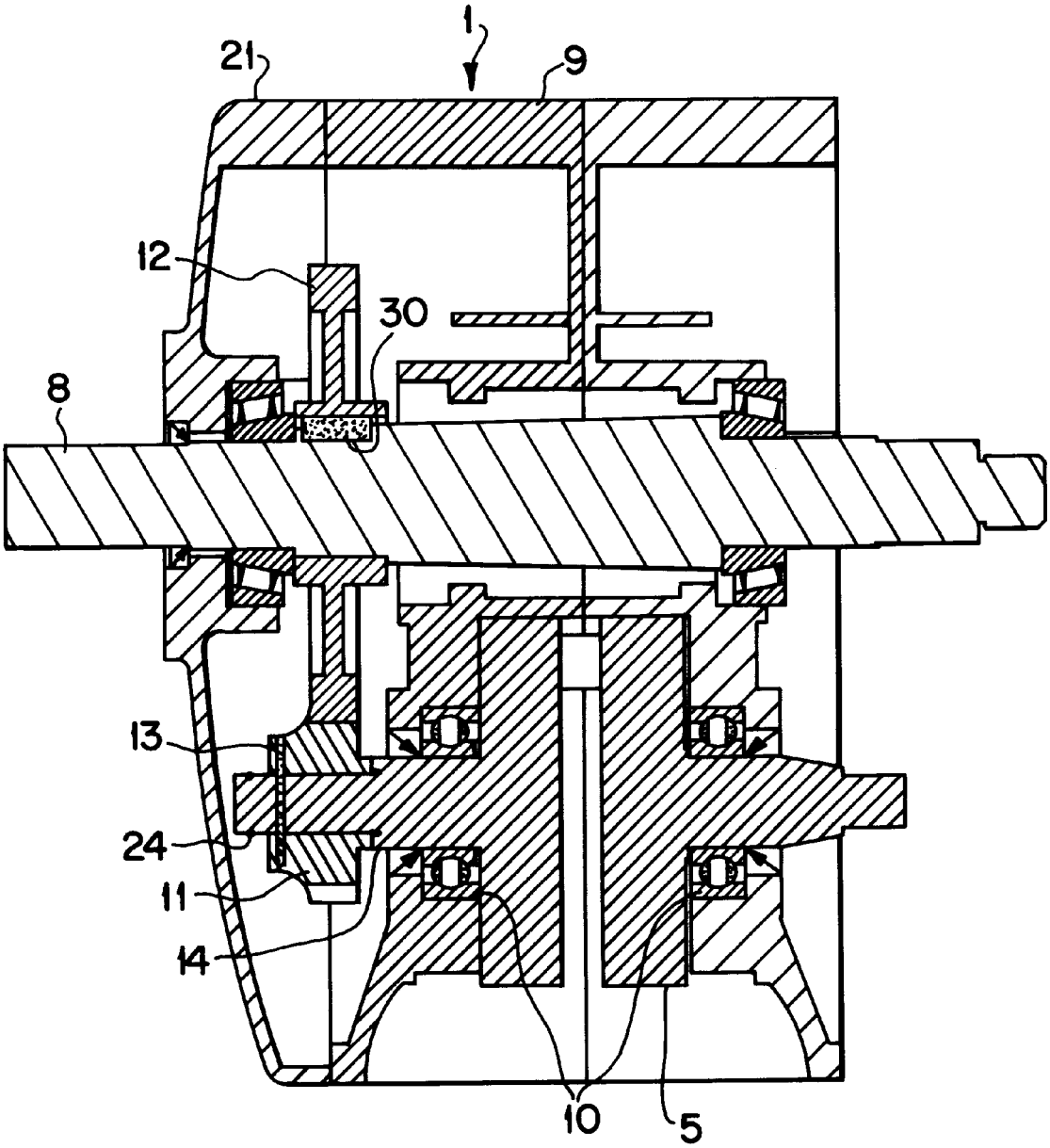
FIG. 2 shows a partial sectional view following line 1—1 of FIG. 1.
Figure 3:
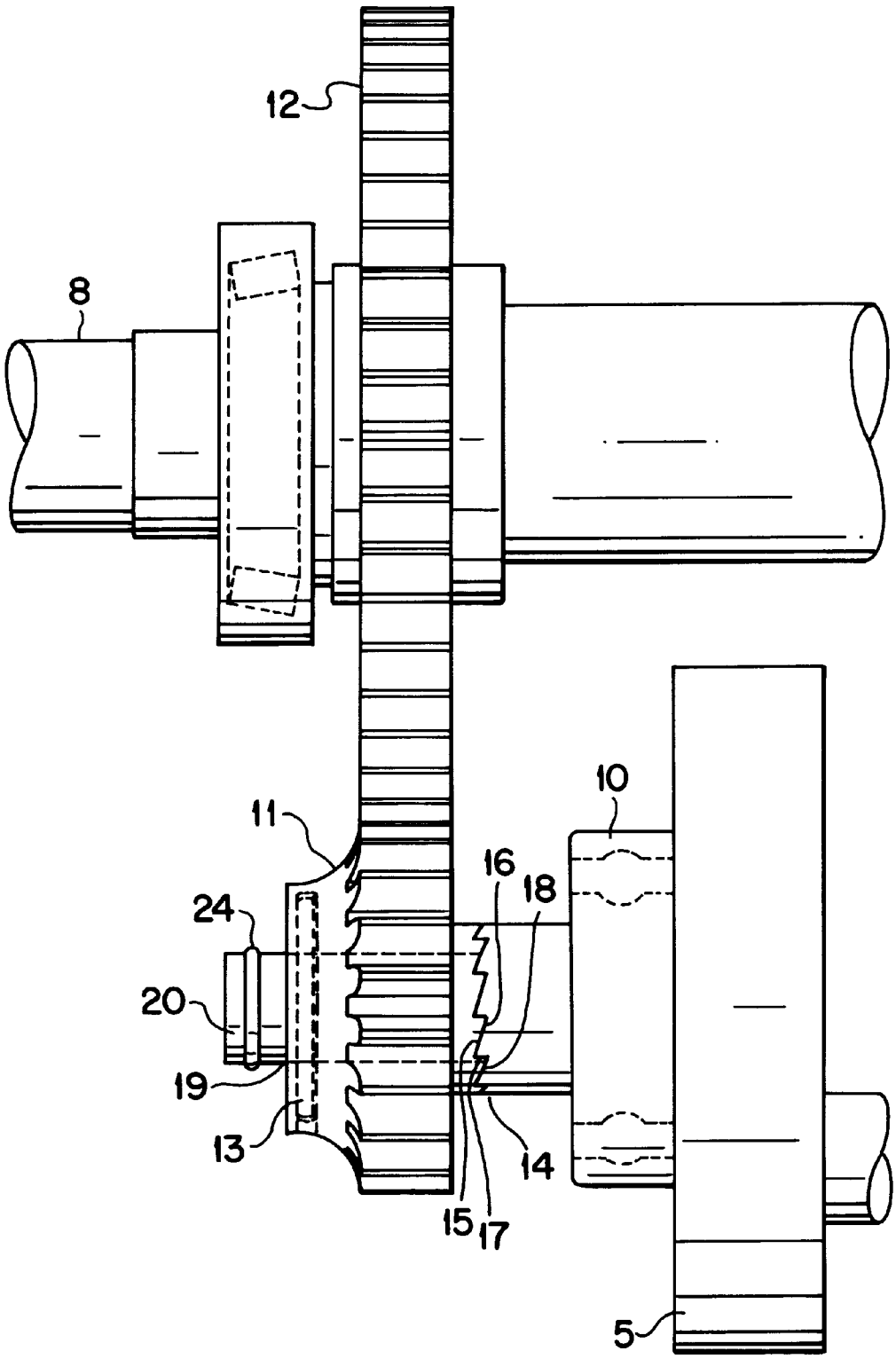
FIG. 3 shows an enlarged detail of FIG. 2, more specifically relative to the obstacle link.

The first, second, and third connections in rotation are advantageously connections by gear, as is represented in FIGS. 1 to 3.

In an advantageous way, the first 11, second 25, and third 26 driving wheels, are tied to a fourth 12 driving wheel completely connected in rotation to the power take-off shaft 8, by any known method, for example by a key 30, as represented in FIGS. 1 and 2.

We should note that the engine represented in FIGS. 1 and 2 allows, advantageously, mounting in which the first 11, second 25, and third 26 driving wheels, and fourth 12 driving wheel are approximately or exactly situated in the same plane, the first 11, second 25, and third 26 driving wheels interdependent respectively of the first 5, second 6, and third 7 crankshafts being tied to the circumference of the fourth 12 wheel driven according to a angular shift, for example equal to 120° in the case of the engine with three cylinder in a star configuration, as represented in FIG. 1. Thus the engine according to the invention possesses an important longitudinal functional density, a simplicity and a rationale of movement transmission, thereby allowing a reduction of the dimensions and weight of the engine, and heightened reliability.

It should be noted that, in the description that follows, only the first obstacle link will be described, the second and third obstacle links being advantageously similar to the first obstacle link. Furthermore, each of the three obstacle links has a function of transmitting the engine load of the crankshaft corresponding to the power take-off shaft while allowing a break in the rotating linkage system between the crankshaft and the power take-off shaft in case of immobility of the crankshaft due, for example, to the seizing of the piston operating the corresponding crankshaft. Several pistons can operate a single crankshaft, if necessary. Thus, the seizing of a piston, for example, allows the engine to function on the two remaining cylinders, due to the declutching of the immobilized crankshaft, which gives the engine in the invention great safety in its functioning.

The first obstacle link includes at least a shearing 13 pin. The pin 13 can be replaced by a shearing key (not represented) or the like, and its dimensions and material will be carefully chosen, since the pin(s) constitutes the sole obstacle to the obstacle link, in a way such that the section(s) of shearing, two in the examples on the figures, resists the transmission of the maximum engine load of the corresponding crankshaft in the normal functioning of the engine, and will be also chosen so that the pin(s) shears under a load inferior or equal to the necessary load to immobilize the corresponding crankshaft when the engine functions.

As represented in FIG. 3, the first obstacle link includes a first shearing 13 pin, or the like, and additionally includes a first driving 14 stop able to transmit the load of the engine created by the first 5 crankshaft toward the power take-off shaft. The first stop's 14 essential function is to keep the engine load from being transmitted by the shearing pin, and to ensure that the shearing pin be utilized solely when the crankshaft opposes a resistance to the power take-off shaft. Thus, the dimensions and the material of the pin will be chosen in a way that it will be sheared under a load inferior or equal to the load necessary to immobilize the first 5 crankshaft when the engine is functioning, the pin being able obviously to resist to the maximum resisting load the crankshaft can oppose the power take-off shaft during normal operation of the engine. Note that on FIG. 3, the crankcase elements are not represented, the represented elements not being in the sectional view.

The first driving 14 stop includes at least one asymmetrical 15 tooth caught in a dent 16 of a complementary shape, with the shearing pin 13, key, or the like, as represented in FIG. 3.

The asymmetrical tooth 15 includes preferably a first face 17 able to transmit the engine load to a second face 18 opposed to the first face 17, to prevent the asymmetrical tooth 15 from catching in the dent 16 in case of break of the shearing pin 13, key, or the like. The first face 17 is preferably included in a plane passing through the axis of rotation of the corresponding crankshaft in such a way that the load transmitted be perpendicular to the face 17, and the second face 18 of the asymmetrical tooth 15 possesses an appropriate inclination, as represented in FIG. 3, in such a way that if tooth 15 is dislodged from the dent 16 when pin 13 breaks, it cannot re-insert itself in it.

It is notable that the presence of the driving stop introduces, by the second face 18 inclined of the tooth 15, an axial component and additional friction to break pin 13, that must be taken into consideration when making the determination of material and dimensions of the pin 13, according to all known methods, for instance calculation of experimental methods.

The first driving 14 stop includes, as represented in FIG. 3, a plurality of teeth 15 forming a first crown stretching in a first plane, perpendicularly to a longitudinal axis of the first 5 crankshaft. The teeth of the crown are preferably identical to those described above. The plurality of teeth allows regular spreading of the tension in a circumferential manner on the first 5 crankshaft and the first driving 11 wheel, and to reduce consequently, the dimensions of the driving 14 stop. The teeth of the crown can be realized on the wheel 11, the dents corresponding being realized on the crankshaft 5, or inversely.

Figure 4:
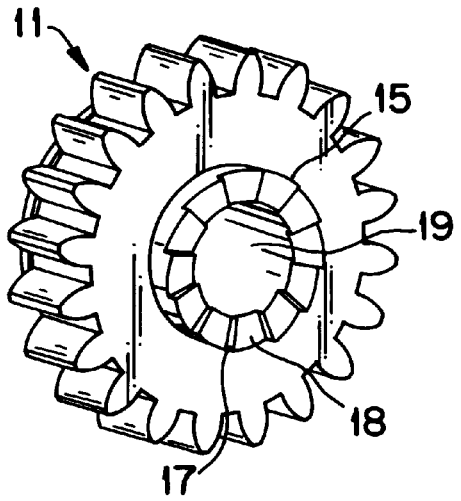
FIGS. 4 and 5 show the same isolated element of FIG. 2, in perspective for FIG. 4 and in a rear view for FIG. 5.
Figure 5:
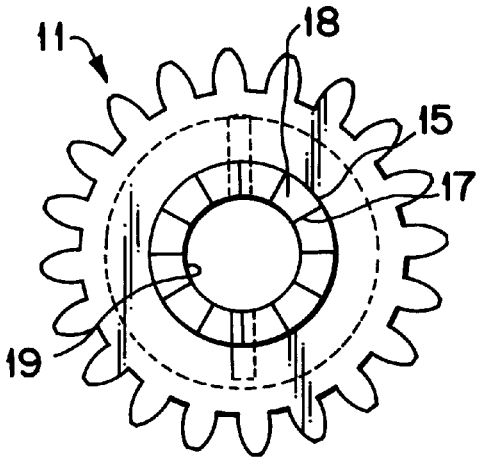

The FIGS. 4 and 5 show the wheel 11 alone, isolated from the link, at the FIG. 3 scale, and shows the crown of asymmetrical teeth 15, including 12 teeth.

Figure 6:
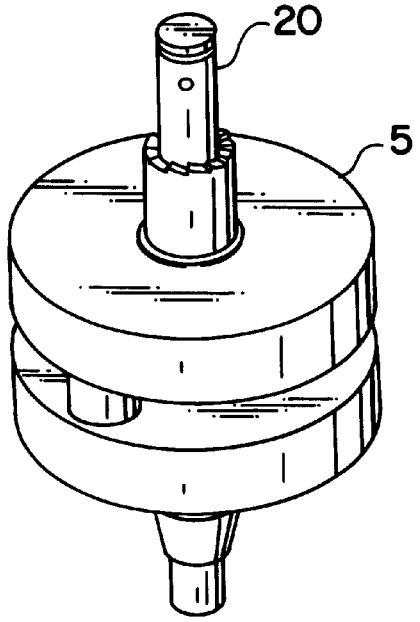
FIGS. 6 and 7 show the same isolated element of FIG. 1, in perspective for FIG. 6 and in a side view for FIG. 5.
Figure 7:
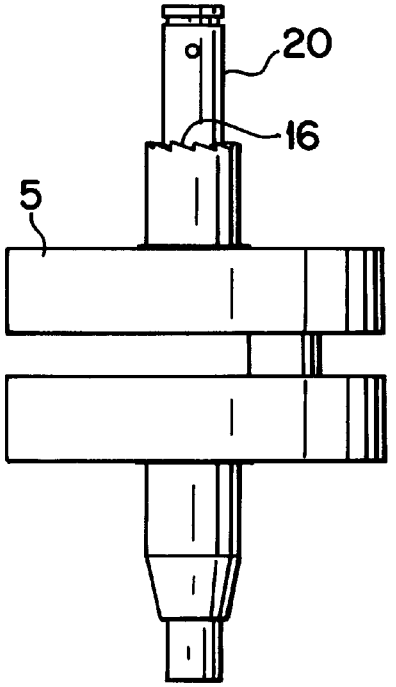

The FIGS. 6 and 7 show the crankshaft 5 alone, at the FIG. 2 scale, and shows the crown of dents 16 complementary to the asymmetrical teeth 15, composing 12 dents. Note that on these figures the presence of a diametric hole in the cylindrical part 20 to accommodate the pin 13, and split to accommodate a rubber collar 24 as will be explained below.

As represented in FIGS. 3 and 5, the first driving wheel 11 possesses a boring 19 allowing its centering on a cylindrical part 20 of cylindrical section at the end of the first crankshaft 5 in such a way that wheel 11 can turn around the crankshaft 5, when there is a break of pin 13. The preceding explanation concerns the first, second, third rotating linkage system indiscriminately.

The engine will be equipped with all known appropriate means intended to reduce friction of a driving wheel to the associated crankshaft in case of a break of the obstacle link, for instance the installation of the wheel on the crankshaft with one or several bearings (not represented) able to additionally allow an eventual shift in translatory motion of the driving wheel on the crankshaft, or by the use of a ring or a bearing 22 (not represented). The material of the bearing will be chosen for its resistance to pressure due to the loads transmitted and for its capacity to reduce friction, for example bronze.

The extremity of the cylindrical part of the crankshaft will be equipped with all necessary means to retain the driving wheel on the crankshaft in case of a break of the obstacle link, for instance a ring or a rubberized collar 24 as represented on FIG. 3.

All the driving wheel and the driven wheel 12 will be contained in a watertight and lubricated crankcase 21, as represented in FIG. 2, so as to ensure lubrication of the connections in rotation between the crankshafts and the power take-off shaft, when these connections necessitate such a lubrication, such as for example connections by metallic gear. This lubrication may be realized by dipping or the like.

The lubrication of the connections in rotation can be utilized to lubricate, if necessary, the rotation of a driving wheel on the crankshaft in case of break of the obstacle link. It should be noted that the crankcase 21 has been removed on FIG. 1 so as to show the connections in rotation.

The connections in rotation between the crankshaft and the power take-off shaft can, in an alternative way and depending upon the utilization of the engine, be realized via chains or belts for example.

What is claimed is:

1. An internal combustion engine comprising:

a rotatable power take-off shaft;

a first crankshaft connected to said power take-off shaft by a first linkage for transmitting power to the power take-off shaft, wherein said first linkage is severable when the first crankshaft is immobilized under a load less than or equal to a load necessary to immobilize said first crankshaft; and a second crankshaft connected to said power take-off shaft by a second linkage for transmitting power to the power take-off shaft, wherein said second linkage is severable under a load less than or equal to a load necessary to immobilize said second crankshaft.

2. The internal combustion engine according to claim 1, wherein said first linkage comprises a first driving wheel mounted on said first crankshaft and fixed relative thereto by way of a first obstacle link, said first obstacle link being constructed and arranged to break under a load less than or equal to a load necessary to immobilized said first crankshaft.

3. The internal combustion engine according to claim 1, wherein said second linkage comprises a second driving wheel mounted on said second crankshaft and fixed relative thereto by way of a second obstacle link, said second obstacle link being constructed and arranged to break under a load less than or equal to a load necessary to immobilize said second crankshaft.

4. The internal combustion engine according to claim 2, wherein said second linkage comprises a second driving wheel mounted on said second crankshaft and fixed relative thereto by way of a second obstacle link, said second obstacle link being constructed and arranged to break under a load less than or equal to a load necessary to immobilize said second crankshaft.

5. The internal combustion engine according to claim 1, further comprising a third crankshaft connected to said power take-off shaft by a third linkage for transmitting power to the power take-off shaft, wherein said third linkage is severable when the third crankshaft is immobilized under a load less than or equal to a load necessary to immobilize said third crankshaft.

6. The internal combustion engine according to claim 5, wherein said third linkage comprises a third driving wheel mounted on said third crankshaft and fixed relative thereto by way of a third obstacle link, said third obstacle link being constructed and arranged to break under a load less than or equal to a load necessary to immobilize said third crankshaft.

7. The internal combustion engine according to claim 2, wherein said first linkage comprises one of a breakable pin and a breakable key.

8. The internal combustion engine according to claim 3, wherein said second linkage comprises one of a breakable pin and a breakable key.

9. The internal combustion engine according to claim 7, wherein said second linkage comprises one of a breakable pin and a breakable key.

10. The internal combustion engine according to claim 6, wherein said third linkage comprises one of a breakable pin and a breakable key.

11. The internal combustion engine according to claim 7, wherein said first linkage further comprises at least one protrusion provided on one of said first crankshaft and said first driving wheel, and a corresponding at least one recess engaged with said at least one protrusion provided on the other of said first crankshaft and said first driving wheel, said engagement between said at least one protrusion and said at least one recess being maintained by said breakable key or breakable pin.

12. The internal combustion engine according to claim 11, wherein said second linkage further comprises at least one protrusion provided on one of said second crankshaft and said second driving wheel, and a corresponding at least one recess engaged with said at least one protrusion provided on the other of said second crankshaft and said second driving wheel, said engagement between said at least one protrusion and said at least one recess being maintained by said breakable key or breakable pin.

13. The internal combustion engine according to claim 12, wherein said second linkage further comprises at least one protrusion provided on one of said second crankshaft and said second driving wheel, and a corresponding at least one recess engaged with said at least one protrusion provided on the other of said second crankshaft and said second driving wheel, said engagement between said at least one protrusion and said at least one recess being maintained by said breakable key or breakable pin.

14. The internal combustion engine according to claim 10, wherein said third linkage further comprises at least one protrusion provided on one of said third crankshaft and said third driving wheel, and a corresponding at least one recess engaged with said at least one protrusion provided on the other of said third crankshaft and said third driving wheel, said engagement between said at least one protrusion and said at least one recess being maintained by said breakable key or breakable pin.

15. The internal combustion engine according to claim 11, wherein said at least one protrusion is an asymmetrical tooth having a first face arranged to permit power transmission from one of said first crankshaft and said first driving wheel to the other of said first crankshaft and said first driving wheel by engagement with said at least one recess, and a second face constructed and arranged to prevent engagement with said at least one recess when said breakable pin or key is broken.

16. The internal combustion engine according to claim 12, wherein said at least one protrusion is an asymmetrical tooth having a first face arranged to permit power transmission from one of said second crankshaft and said second driving wheel to the other of said second crankshaft and said second driving wheel by engagement with said at least one recess, and a second face constructed and arranged to prevent engagement with said at least one recess when said breakable pin or key is broken.

17. The internal combustion engine according to claim 15, wherein said at least one protrusion is an asymmetrical tooth having a first face arranged to permit power transmission from one of said second crankshaft and said second driving wheel to the other of said second crankshaft and said second driving wheel by engagement with said at least one recess, and a second face constructed and arranged to prevent engagement with said at least one recess when said breakable pin or key is broken.

18. The internal combustion engine according to claim 14, wherein said at least one protrusion is an asymmetrical tooth having a first face arranged to permit power transmission from one of said third crankshaft and said third driving wheel to the other of said third crankshaft and said third driving wheel by engagement with said at least one recess, and a second face constructed and arranged to prevent engagement with said at least one recess when said breakable pin or key is broken.

19. The internal combustion engine according to claim 15, wherein said at least one protrusion comprises a plurality of teeth forming a first crown spreading in a first plane perpendicular to a longitudinal axis of said first crankshaft.

20. The internal combustion engine according to claim 17, wherein said at least one protrusion comprises a plurality of teeth forming a second crown spreading in a second plane perpendicular to a longitudinal axis of said second crankshaft.

21. The internal combustion engine according to claim 4, further comprising a driven wheel engaged with said power take-off shaft and engaged with said first and second driving wheels.

22. The internal combustion engine according to claim 21, wherein said first and second driving wheels and said driven wheel are generally coplanar.

* * * * *